United States Patent [19]

Hankison

[11] Patent Number: 4,647,212

[45] Date of Patent: Mar. 3, 1987

[54] CONTINUOUS, STATIC MIXING APPARATUS

[75] Inventor: Paul M. Hankison, McMurray, Pa.

[73] Assignee: ACT Laboratories, Inc., McMurray, Pa.

[21] Appl. No.: 638,610

[22] Filed: Mar. 11, 1986

[51] Int. Cl.[4] ..... B01F 5/00; B01F 15/02

[52] U.S. Cl. ..... 366/165; 137/896; 366/167; 366/173; 366/177; 366/340; 366/341

[58] Field of Search ..... 366/336–341, 366/165, 167, 176, 177, 173; 137/896–898; 138/42

[56] References Cited

U.S. PATENT DOCUMENTS

| | | | |
|---|---|---|---|
| 2,815,532 | 12/1957 | Braunlich | 137/896 X |
| 3,128,794 | 4/1964 | Boucher et al. | 366/340 X |
| 3,582,048 | 6/1971 | Sarem | 366/340 |
| 3,905,395 | 9/1975 | Hype | 366/177 |
| 4,266,951 | 5/1981 | Calvert | 55/84 |
| 4,474,477 | 10/1984 | Smith et al. | 366/165 |
| 4,537,314 | 8/1985 | Skardal | 209/211 |

*Primary Examiner*—Timothy F. Simone

*Attorney, Agent, or Firm*—Webb, Burden, Robinson & Webb

[57] ABSTRACT

A mixing apparatus includes an elongated cylindrical mixing chamber having a hollow body and opposed end walls. The mixer also includes a first entry port extending through a first of the end walls and into the mixing chamber, with a first nozzle plate mounted within the mixing chamber and adjacent the first entry port. The mixer also includes a second entry port extending through the remaining end wall and into the mixing chamber, with a second nozzle plate mounted within the mixing chamber and adjacent to the second entry port. The nozzle plates are spaced apart from one another within the mixing chamber. The mixer also has a discharge port extending through the hollow body and into the mixing chamber. The mixer may also include an intake port extending through the hollow body and into the mixing chamber. The intake and the discharge ports are preferably positioned longitudinally on the hollow body between the nozzle plates and opposite one another. The nozzle plates may include a plurality of bores extending therethrough which are spaced about the center of the nozzle plate, which diverge outwardly toward the hollow body at an angle relative to the longitudinal axis of the chamber, and which are skewed with respect to a radial line extending outwardly from the center of the nozzle plate.

8 Claims, 8 Drawing Figures

CONTINUOUS, STATIC MIXING APPARATUS

DESCRIPTION

BACKGROUND OF THE INVENTION

1. Field of the Invention

This invention relates to an apparatus for mixing together a plurality of flowable materials, such as a liquid with another liquid, a liquid with a gas, a liquid with a dry granular or powder material, a liquid with solids in a slurry or a suspension, or various combinations of these materials.

2. Background Art

Mixers can be generally classified as either a continuous type or a batch type. In a continuous mixer, a plurality of flowable materials, such as liquids, gases, powders, and the like are supplied at a particular flow rate into a mixing chamber and are mixed by their velocity and turbulence or by mechanical stirring, or both. Known continuous mixers do not always provide sufficient contact between the molecules of the materials to effect complete mixing. If the object of the mixing is a reaction, such as when a reagent is added to adjust the chemistry of acidic mine water, more reagent than is needed for the reaction is used to compensate for the inefficiency in mixing and to achieve as much contact by the reagent as possible. The inefficiency of the mixer results in extra cost from the use of excess reagent as well as the energy involved in operating the mechanical mixer.

In a batch type of mixer, two or more materials are placed in a container and mixed together by stirring, rotation, tumbling or the like. It is also common to mix oxygen with liquids, such as contaminated water, by either surface, turbine or bubble aerators in conjunction with large settling ponds. Such batch type mixers have several disadvantages. The mixing is rather slow since the materails are fed into the mixer, then mixed for a time period until the entire volume is mixed, and then removed from the mixing chamber. These mixers are also generally large, especially so with settling ponds, since an entire batch is treated at one time. Moreover, batch mixers are not generally efficient in operation.

It is an object of the present invention to provide a continuous type of mixer which efficiently and thoroughly mixes together a plurality of materials.

It is a further object to provide a mixer which is totally static in operation and includes no moving elements. Furthermore, such a device will require little maintenance or downtime and will be very simple of construction.

Moreover, it an object of the present invention to provide a mixer which is flexible in design, can accommodate a variety of specific needs, and can be used in a variety of system configurations.

SUMMARY OF THE INVENTION

Accordingly, I have invented a mixing apparatus which comprises an elongated cylindrical mixing chamber having a hollow body and opposed end walls. The mixer has a first entry port extending through a first of the end walls and into the mixing chamber, with a first nozzle plate mounted within the mixing chamber and adjacent the first entry port. The mixer also includes a second entry port extending through the remaining end wall and into the mixing chamber, with a second nozzle plate mounted within the mixing chamber and adjacent to the second entry port. The nozzle plates are spaced apart from one another within the mixing chamber. The mixer also has a discharge port extending through the hollow body and into the mixing chamber. The discharge port is positioned longitudinally on the hollow body between the nozzle plates. The entry ports and the nozzle plates are positioned to direct a fluid flowing through an entry port, through an adjacent nozzle plate and toward the opposite nozzle plate. In this manner, a fluid entering one entry port will contact and mix thoroughly within the mixing chamber with a fluid entering from the opposite entry port. The mixed fluids will flow out of the mixing chamber through the discharge port.

An additional fluid can be mixed within the chamber by further including an intake port extending through the hollow body and into the mixing chamber. The intake port is positioned longitudinally on the hollow body between the nozzle plates and opposite the discharge port. The intake port is adapted to direct flowable materials into the mixing chamber.

Each nozzle plate has an inner face, an opposed outer face, and a plurality of bores extending therethrough between the inner face and the outer face. The inner face of each nozzle is directed toward the adjacent end wall of the mixing chamber and the outer faces of the nozzle plates are directed toward each other. The nozzle plate may also be formed of a thin member having a plurality of nozzle tubes set in the thin member and extending therethrough. The diameter of the discharge port is preferably larger than the diameter of both the entry ports and the intake port.

The bores are preferbly spaced about the center of the nozzle plate. It is preferred that the bores each diverge outwardly toward the hollow body and at an angle relative to the longitudinal axis of the chamber as the bore extends from the inner face to the outer face of the nozzle plate. In this manner, fluids passing through the bores will have a component of motion directed outwardly toward the hollow body of the mixing chamber and a component of motion inwardly toward the opposite nozzle plate. The bores diverge outwardly at an angle of from about 25° to about 35°, with a preferred angle of about 30°. Moreover, it is preferred that the bores be each skewed with respect to a radial line extending outwardly from the center of the nozzle plate. In this manner, fluids passing through the bores will have a rotary component of motion relative to the radius of the mixing chamber. Ideally, the bores of each nozzle plate are skewed in the same direction, such that fluids passing through the bores of one nozzle plate will have a rotary component of motion in a direction opposite to that of fluids passing through the bores of an opposite nozzle plate. The bores ae skewed at an angle of from about 10° to about 20°, with a preferred angle of about 15° degrees.

DESCRIPTION OF THE PREFERRED EMBODIMENTS

Figure 1:
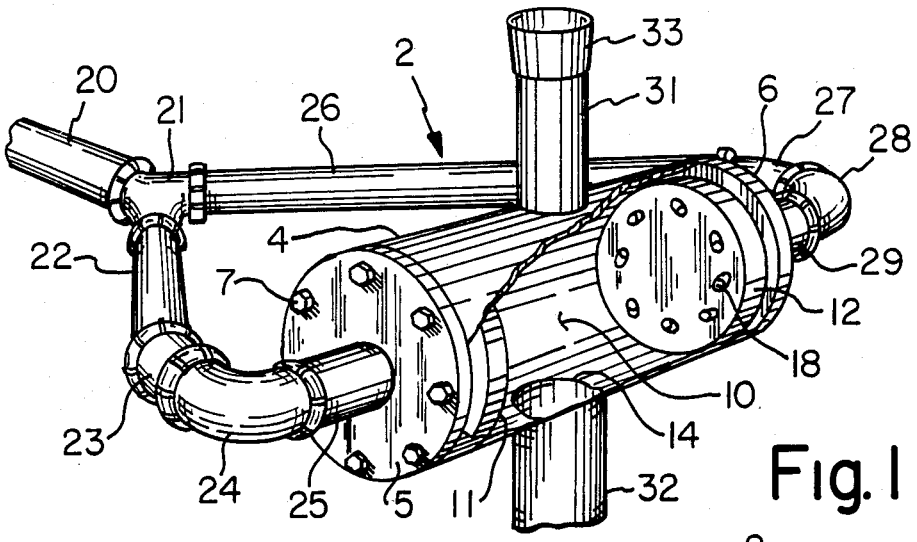
FIG. 1 is a perspective view of a first embodiment of a mixing apparatus in accordance with the present invention, partially broken away.
Figure 2:
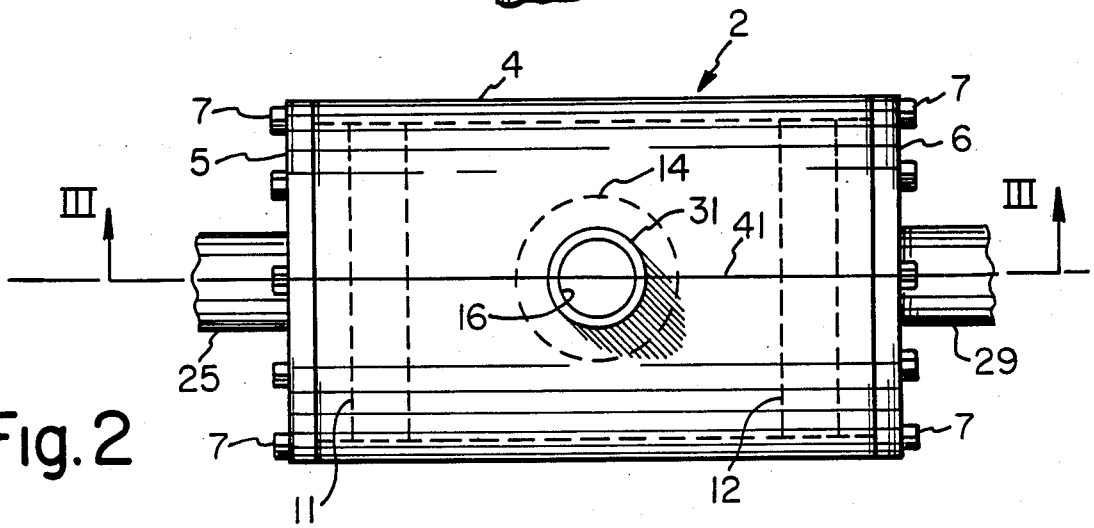
FIG. 2 is a top plan view of the mixer shown in FIG. 1.
Figure 3:
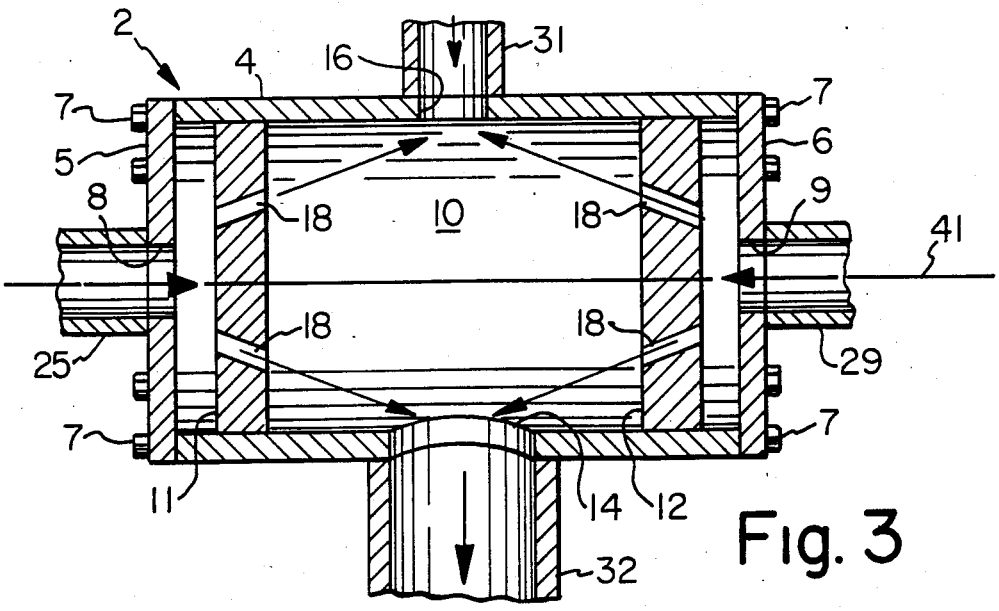
FIG. 3 is a section taken along lines III—III in FIG. 2.

A first embodiment of a mixer in accordance with the present invention is shown in FIGS. 1–3. Mixer 2 includes an elongated, cylindrical hollow body 4 which is closed off by first end wall 5 at one end thereof and by second end wall 6 at the opposite end thereof. Hollow body 4, first end wall 5 and second end wall 6 define and surround a hollow mixing chamber 10. The end walls 5, 6 may be welded to hollow body 4 or may be affixed thereto by bolts 7 as shown or by any other suitable fastening means.

A first entry port 8 extends through the first end wall 5 and into the mixing chamber 10. A second entry port 9 extends through the second end wall 6 and into the mixing chamber 10. A first nozzle plate 11 is mounted to the hollow body 4 within the mixing chamber 10 and is positioned adjacent to but spaced away from the first entry port 8. Similarly, a second nozzle plate 12 is mounted to the hollow body 4 within the mixing chamber 10 and is positioned adjacent to and spaced away from the second entry port 9. The first nozzle plate 11 is opposed to and spaced away from the second nozzle plate 12. A discharge port 14 extends through the hollow body 4 and into the mixing chamber 10. The discharge port 14 is positioned longitudinally on the hollow body 4 between the first nozzle plate 11 and the second nozzle plate 12. The mixer 2 further includes an intake port 16 which extends through the hollow body 4 and into the mixing chamber 10. The intake port 16 is positioned longitudinally on the hollow body 4 between the nozzle plates 11, 12 and opposite the discharge port 14. The nozzle plates 11, 12 each have a plurality of nozzle bores 18 extending therethrough.

In the arrangement shown in FIGS. 1–3, the mixer 2 can be used to mix together two fluids within the mixing chamber 10. Although the term "fluid" is used to describe the materials mixed together in the mixer 2, it is to be understood that true fluids, such as liquids and gases, as well as other fluid-like or flowable materials, such as a dry granular or powder material or a liquid with solids in a slurry or a suspension, or various combinations thereof, can be accommodated in the mixer 2 of the present invention. A first fluid can be supplied to the mixer 2 by way of intake conduit 20 which is connected to Y connector 21 which splits this fluid into two portions which are supplied at opposite ends of the mixer 2. A portion of the first fluid will flow out of one branch of Y connector 21, through conduit 22, connector 23, elbow 24 and conduit 25. Conduit 25 is attached to the first end wall 5 in fluid communication with the first entry port 8. Similarly, the remainder of the first fluid will pass out of the other branch of Y connector 21, through conduit 26, connector 27, elbow 28, and conduit 29. Conduit 29 is attached to the second end wall 6 in fluid communication with the second entry port 9. The fluid entering mixer 2 through the first entry port 8 will pass through the bores 18 in the first nozzle plate 11 and be split into a plurality of streams which are directed toward the middle of the mixing chamber 10. Similarly, the fluid entering mixer 2 through the second entry port 9 will pass through the bores 18 in the second nozzle plate 12 and be split into a plurality of streams which are directed toward the middle of the mixing chamber 10. The streams will collide in the middle of the mixing chamber 10 as shown by the arrows in FIG. 3.

A second fluid can be injected into the mixing chamber 10 of mixer 2 by means of the intake conduit 31 which is attached to the hollow body 4 and is in fluid communication with the intake port 16. Both the first and second fluids will be mixed together within the mixing chamber 10 and will pass out of mixer 2 through discharge port 14 and through discharge conduit 32 which is attached to the hollow body 4 and is in fluid communication with discharge port 14. The mixed fluid will then pass through discharge conduit 32 to a desired location. The intake conduit 31 is particularly useful in supplying gases, particulate materials, or combinations thereof into the mixing chamber 10 of mixer 2. In the arrangement shown in FIG. 1, intake conduit 31 is set up for introducing either a powdered material or air or both directly into the interior of the mixer 2. A flange 33 may be provided at the free end of intake conduit 31 to facilitate introduction of the air or powdered material into the mixer 2.

The key to the operation of the mixer of the present invention is in the design, arrangement, and positioning of the nozzle plates 11, 12. The first nozzle plate 11 is shown in more detail in FIGS. 4 and 5. The second nozzle plate 12 is either similar to or identical with the first nozzle plate 11. Nozzle plate 11 has an inner face 36 and an opposed and generally parallel outer face 37 opposte thereto. Nozzle plate 11 includes a plurality of nozzle bores 18 which extend therethrough between the inner face 36 and the outer face 37. When the nozzle plates are positioned within the hollow body 4 of the mixer 2, the inner face of each nozzle plate will be directed toward an adjacent end wall 5 or 6 and the outer face of the first nozzle plate 11 will be directed toward the outer face of the second nozzle plate 12.

Figure 5:
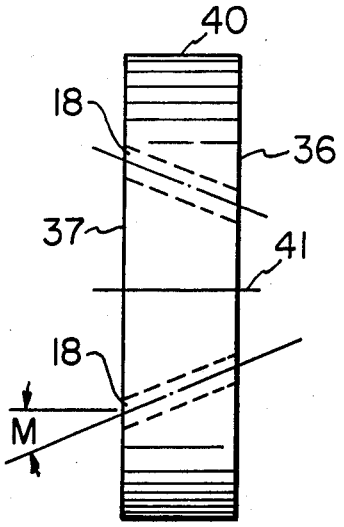
FIG. 5 is a side view of the nozzle plate shown in FIG. 4.

The nozzle bores 18 are generally spaced about the center 39 of nozzle plate 11. As seen more clearly in FIG. 5, each bore 18 diverges outwardly toward the outer edge 40 of nozzle plate 11, and hence, toward the hollow body 4 as the bore 18 extends from the inner face 36 to the outer face 37. The bores 18 also diverge outwardly relative to the longitudinal axis 41 of mixing chamber 10. The bores 18 diverge outwardly at an angle M as shown in FIG. 5. The bores 18 diverge outwardly at an angle of from about 25° to about 35° and, in a preferred embodiment, diverge outwardly at an angle of about 30°. Since the bores 18 enter the faces 36, 37 of nozzle plate 11 at an angle, they will form ellipses on the surface thereof rather than circles which would result from a straight through bore. This inclination of the bores 18 will cause fluids flowing therethrough to have a component of motion outwardly toward the hollow body 4 and a component of motion inwardly toward an opposite nozzle plate 11, 12.

Figure 4:
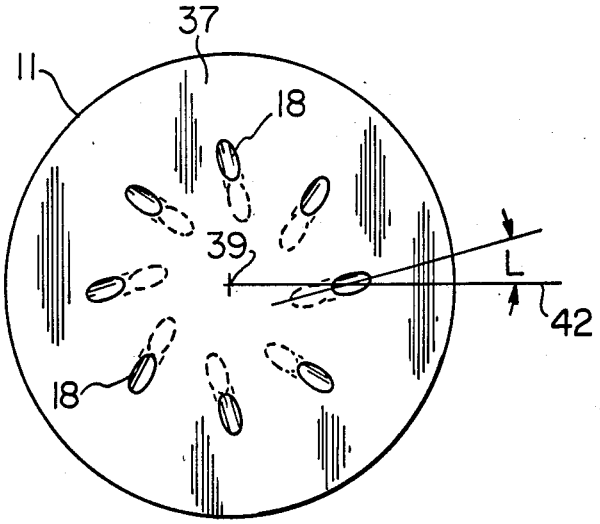
FIG. 4 is a front elevational view of a nozzle plate in the mixer shown in FIG. 1.

In addition, each bore 18 is skewed with respect to an imaginary line 42 which extends radially outwardly from the center 39 of the nozzle plate 11. By such skewing of the bores 18, fluids passing through the nozzle plates will have a rotary component of motion relative to the radius of the mixing chamber 10. The bores 18 on a nozzle plate should all be skewed in the same direction. It is preferred that the bores 18 of each nozzle plate be skewed along the same direction. When identical nozzle plates are positioned opposite each other, fluid passing through the bores of one nozzle plate will have a rotary component of motion in a direction opposite to a fluid passing through the bores of the other nozzle plate. The angle of skewing of the bores 18 is shown in FIG. 4 by angle L. It is desirable that the bores 18 be skewed at an angle of from about 10° to about 20°, preferably at an angle of about 15°.

It can be appreciated that fluid flowing or forced against the inner face 36 of a nozzle plate will be broken up into a plurality of streams by means of the bores 18. In addition, each stream will be caused to flow both inwardly toward the middle of the mixing chamber 10 and outwardly toward the hollow body 4 and away from the longitudinal axis 41 through the mixing chamber 10. In addition, the skewing of the bores 18 will cause the fluid streams to rotate in a spiral or twisting manner about the longitudinal axis 41 of the mixing chamber 10. It is desirable and highly preferred that the twisting action of the streams of fluid passing out of the nozzle plates be oriented opposite of one another so that the streams hit each other in the middle of the mixing chamber 10 at a glacing angle. This can be accomplished by providing the first nozzle plate 11 to be identical to the second nozzle plate 12 and positioning them with the outer faces thereof opposed to one another. In the embodiment shown in FIGS. 1–3, the fluid passing out of the first nozzle plate 11 will be twisted in a clockwise manner while the fluid flowing out of the bores 18 in the second nozzle plate 12 will be twisted in a counterclockwise manner. These streams will travel at such an angle so as to meet in the center and at the walls of the mixing chamber 10 in an intermingled fashion as to create a hydraulic shear of the opposing fluid streams. The result is a highly turbulent mixing pattern since the shearing action tears the fluids into tiny particles which can easily be intermixed.

The mixed fluid will then flow out of the mixing chamber 10 by means of the discharge port 14. If the discharge port 10 and discharge conduit 32 are of a proper diameter to accommodate the fluid flow, the weight of the discharged fluid creates a low pressure condition in the mixing chamber 10. When an opening is created in the top of the mixing chamber 10, such as by means of intake port 16, atmospheric air rushes in to fill the low pressure area. Aeration of the fluid is accomplished by air entering the top of the mixing chamber 10 due to the low pressure created therein. The air enters the mixing chamber where it comes into contact with the highly turbulent fluid thus turning it into a frothy mass of bubbles, greatly increasing the surface area. Another flowable materials, such as a powdered reagent, may be passed into the chamber through the intake port 16 along the atmospheric air. The velocity of the intake air helps to carry the powdered material directly into the turbulent fluid with little propensity to clog.

The nozzle plates 11, 12 are positioned from one another so that the individual streams coming out of the bore 18 will meet each other at the body 4 of the mixing chamber 10 where the velocity is the greatest. In this manner, the greatest agitation of the fluids and the greatest mixing action will result. The precise position and separation of the nozzle plates 11, 12 will be determined by the size and configuration of the mixing chamber 10 and also on the pressure and flow rate of the fluids. The spacing of the nozzle plates 11, 12 can be easily adjusted in order to obtain the optimal mixing by merely observing the mixing patterns or the results of the mixing within the mixing chamber 10.

Figure 6:
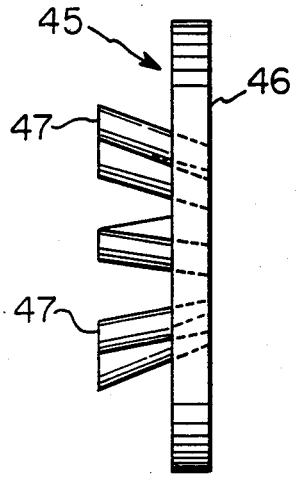
FIG. 6 is a side view of an alternate embodiment of a nozzle plate.

Rather than make the nozzle plate as a thicker plate with bores extending completely therethrough as shown in FIGS. 4 and 5, it is possible to make the nozzle plate out of a relatively thin member having a plurality of nozzle tubes set therein as shown in FIG. 6. Nozzle plates 45 includes a thin plate 46 with a plurality of hollow nozzle tubes 47 set in the thin plate 46 and extending therethrough. These nozzle tubes 47 will diverge outward and be skewed in the same manner as the bores 18 discussed above in connection with the first nozzle plate 11 and will function in the same way.

Figure 7:
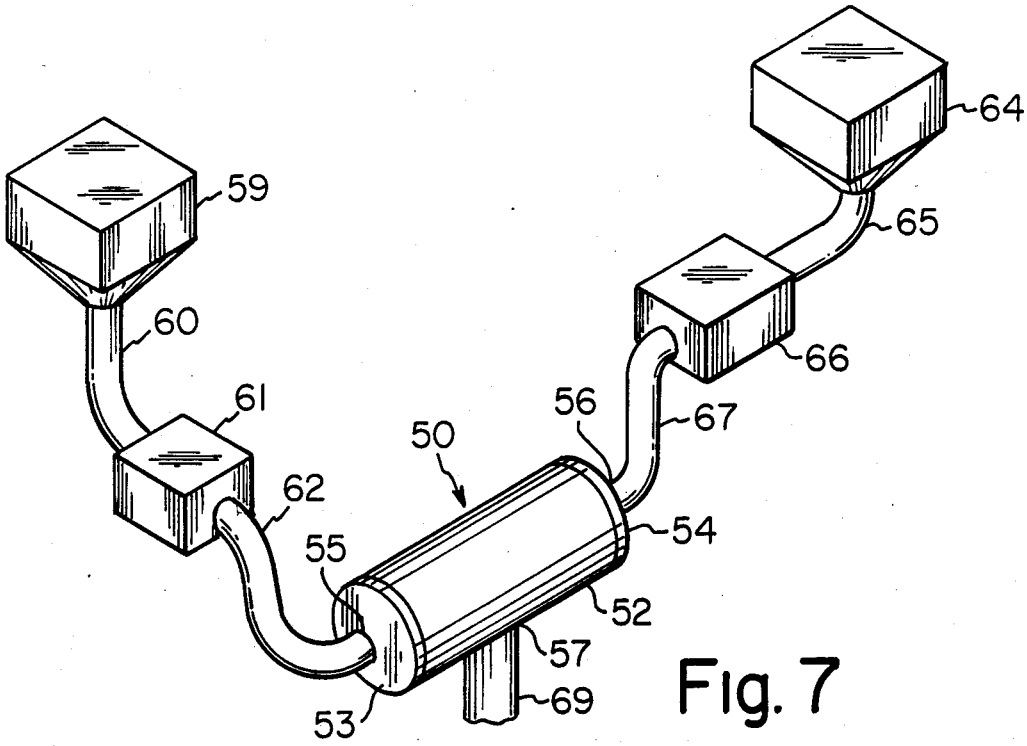
FIG. 7 is a perspective view of a fluid mixing system utilizing a second embodiment of a fluid mixer in accordance with the present invention.

A second embodiment of a mixer in accordance with the present invention is shown in a fluid mixing system in FIG. 7. The mixer 50 is similar to mixer 2 shown above in connection with FIGS. 1–3 and includes an elongated, cylindrical hollow body 52 with a first end wall 53 and opposed second end wall 54 closing off the hollow body 52 and forming a mixtre chamber therein. The first end wall 53 has a first entry port 55 therethrough and the second end wall 54 has a second entry port 56 therethrough. The hollow body 52 also has a discharge port 57 therethrough. Unlike the fluid mixer 2 shown above, the fluid mixer 50 shown in FIG. 7 does not include a separate intake port. Mixer 50 is suited for mixing together two fluids which are moved therethrough under pressure.

As shown in FIG. 7, a first fluid source 59 supplies a first fluid to conduit 60, through pump 61 and through conduit 62 into the first entry port 55 of the mixer 50. The flow rate of the first fluid into the mixer 50 can be controlled by directly controlling the operation of pump 61 as is known in the art. Similarly, a second fluid can be supplied to the mixer 50 from a second fluid source 64, through conduit 65, pump 66 and conduit 67 directly into the second entry port 56. Pump 66 can also be controlled to determine the flow rate of the second fluid into mixer 50. The two fluids will flow through the nozzle plates contained within the fluid mixer 50 and be mixed together in a thorough manner as described above and thereafter flow out through discharge port 56 via discharge conduit 69.

This mixer 50 is suitable for either mixing together two diverse fluids or blending together a single fluid which is broken down into various components. For example, raw milk is known to contain large globules of butter fat and is typically homogenized to provide a consistent and uniform product. Milk can be homogenized through the use of the mixer 50 shown in FIG. 7 by merely suppling a portion of the milk to each end of the mixer 50 through the first entry port 55 and the second entry port 56. Therein the milk will pass through the nozzle plates and be mixed within the chamber as discussed above. The highly turbulent mixing action from the mixer 50 will break down the fat globules and smooth out and homogenize the milk in a very efficient and speedy manner. It is also possible to treat milk or any other two fluids in this manner by using the embodiment of the mixer 2 shown in FIG. 1 by merely plugging off the intake port 16 or intake conduit 31 and thereafter supplying the two fluids in a pressurized manner to the opposite ends of the mixing chamber 10.

Figure 8:
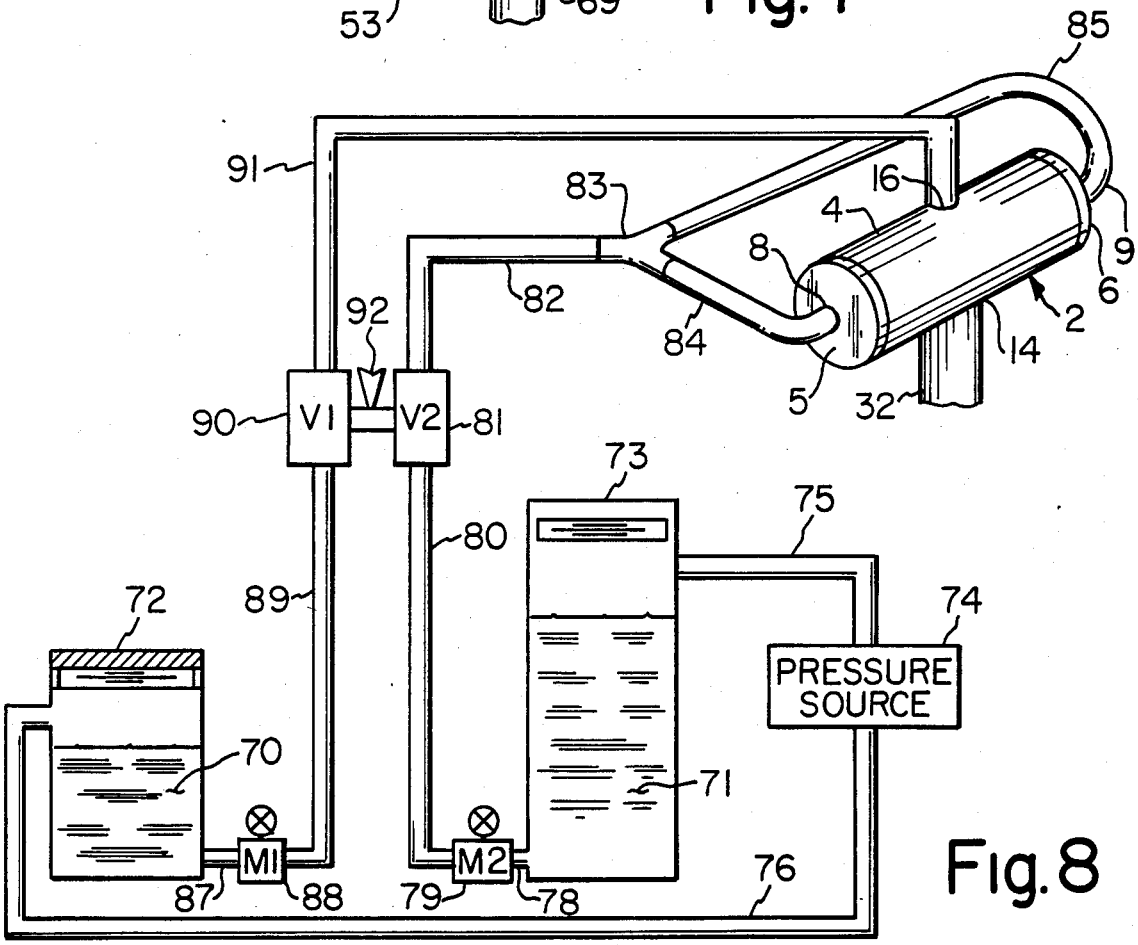
FIG. 8 is a schematic diagram of a system for mixing together a plurality of flowable materials utilizing the mixer shown in FIG. 1.

A fluid mixing system utilizing the mixer 2 shown in FIGS. 1–3 is shown in FIG. 8. This system is adapted to mix together an additive 70, such as concentrated orange juice or the like, to a liquid 71, such as water. The additive 70 is stored in storage tank 72 and the fluid 71 is stored in storage tank 73. In order to move the additive 70 and the fluid 71 from the storage tanks 72, 73 to the mixer 2, a pressure source 74, such as a compressed gas cylinder or the like, is connected via pressure conduit 75 to storage tank 73 and via pressure conduit 76 to storage tank 72. A suitable pressure source can be nitrogen, $CO_2$ or compressed air. Alternatively, a standard pump can be used to move the additive 70 and fluid 71 to the mixer 2. The fluid 71 will exit storage tank 73 and pass through exit conduit 78, through metering valve 79, conduit 80, on/off valve 81, and conduit 82 before arriving at the Y connector 83. Thereafter, the fluid 71 will be split between conduit 84 and conduit 85 and will be supplied to the first entry port 8 in first end plate 5 and to the second entry port 9 in second end plate 6 of mixer 2 as discussed hereinabove. The additive 70 will pass out of the storage tank 72 through exit conduit 87, metering valve 88, conduit 89, on/off valve 90, and conduit 91 and will be supplied to the intake port 16 of the mixer 2 as discussed hereinabove. The additive 70 will be thoroughly mixed with the fluid 71 within mixer 2 as discussed above and will exit mixer 2 through discharge port 14 and discharge conduit 32. The additive 70 will be totally emulsified with the fluid by means of the turbulent action within the mixer 2. The metering valves 79 and 88 are used to control the ratios of additive 70 to fluid 71. On/off valves 81 and 90 are preferably ball valves which are jointly connected together via handle 92 and are used to start and stop the flow of additive 70 and fluid 71 to mixer 2 in a synchronized fashion.

The mixing apparatus of the present invention may be use for a wide variety of mixing applications such as, for example, the addition of chemicals to waste materials such as acidic mine water, sewage and the like to adjust the chemistry of the waste materials. When treating acidic mine water or sewage, the mixing apparatus of this invention eliminates the need for bulk tank mixing, chemical reaction vessels and diffused aeration basins. Efficient treatment of waste materials is accomplished because the chemicals supplied to the waste materials mix and react with the waste materials in the turbulent and highly reactive mixing area of the mixing chamber. Since the opposed flows of the fluid streams passing through the nozzle bores create a hydraulic shear and break the fluid into very tiny particles, the reaction of the chemicals with the substances in the waste materials will be enhanced due to the increased surface area of the fluid. In addition, the mixing apparatus of the present invention can be used to mix together other materials such as paints, foods, beverages, particulate matter with liquids, and many other materials. The material passing through the mixer of the present invention may be a liquid, a gas, or a solid or any other flowable material, or a combination thereof.

It is preferably that the hollow body be provided of a regular cylindrical shape and that the end walls and the nozzle plates be cylindrical plates. It is also anticipated that the mixer will be manufactured of material such as stainless steel or a high strength and quality plastic such as polyvinylchloride. The mixer will have no moving parts and thus make replacement parts and time-consuming repair unnecessary. A pressure gauge can be supplied at each entry port in order to detect blockage of the nozzles by showing a slight pressure differential therein.

Having described hereinabove the preferred embodiments of the present invention, it is to be understood that the invention may be otherwise embodied within the scope of the appended claims.

I claim:

1. A mixing apparatus comprising an elongated, cylindrical mixing chamber having a hollow body and opposed end walls, said mixing apparatus further including a first entry port extending through a first of said end walls and into said mixing chamber, a first nozzle plate mounted within said mixing chamber and adjacent said first entry port, a second entry port extending through a second of said end walls and into said mixing chamber, a second nozzle plate mounted within said mixing chamber and adjacent said second entry port and spaced from said first nozzle plate, a discharge port extending through said body and into said mixing chamber, said discharge port positioned longitudinally on said hollow body between said nozzle plates, said entry ports and nozzle plates positioned to direct a fluid flowing through an entry port, through an adjacent nozzle plate and toward an opposite nozzle plate, each nozzle plate having an inner face, an opposed outer face, and a plurality of bores extending therethrough between said inner face and outer face and spaced about the center of said nozzle plate, with the inner face of each nozzle plate directed toward said adjacent end wall and with the outer faces of the nozzle plates directed toward each other, said bores each diverging outwardly toward said body and at an angle relative to the longitudinal axis of the chamber as the bore extends from said inner face to said outer face, said bores being skewed with respect to a radial line extending outwardly from the center of said nozzle plates, and said bores of each nozzle plate being skewed in the same direction, such that a fluid entering one entry port will contact and mix thoroughly within said mixing chamber with a fluid entering the opposite entry port and the mixed fluids will exit said mixing chamber through said discharge port, whereby fluids passing through said bores have a component of motion outwardly toward said body of said mixing chamber, a component of motion inwardly toward an opposite nozzle plate, a rotary component of motion relative to the radius of said mixing chamber, and a rotary component of motion in a direction opposite to that of fluids passing through the bores of an opposite nozzle plate.

2. The mixing apparatus as set forth in claim 1 further including an intake port extending through said body and into said mixing chamber, said intake port positioned longitudinally on said hollow body between said nozzle plates and opposite said discharge port, said intake port adapted to direct flowable materials into said mixing chamber.

3. The mixing apparatus as set forth of claim 1 wherein said nozzle plate is a thin member having a plurality of nozzle tubes set in said member and extending therethrough.

4. The mixing apparatus as set forth in claim 1 wherein said bores diverge outwardly at an angle of from about 25° to about 35°.

5. The mixing apparatus as set forth in claim 6 wherein said bores diverge outwardly at an angle of about 30°.

6. The mixing apparatus as set forth in claim 1 wherein said bores are skewed at an angle of from about 10° to about 20°.

7. The mixing apparatus as set forth in claim 1 wherein said bores are skewed at an angle of about 15°.

8. The mixing apparatus as set forth in claim 2 wherein said discharge port has a diameter larger than the diameter of said entry ports or said intake ports.

* * * * *